US009976243B2

(12) United States Patent
Kim et al.

(10) Patent No.: US 9,976,243 B2
(45) Date of Patent: May 22, 2018

(54) WASHING MACHINE MOTOR AND WASHING MACHINE COMPRISING SAME

(71) Applicant: AMOTECH CO., LTD., Incheon (KR)

(72) Inventors: Byung Soo Kim, Anyang-si (KR); Hyung Hwan Ko, Anseong-si (KR)

(73) Assignee: AMOTECH CO., LTD., Incheon (KR)

( * ) Notice: Subject to any disclaimer, the term of this patent is extended or adjusted under 35 U.S.C. 154(b) by 158 days.

(21) Appl. No.: 15/022,000

(22) PCT Filed: Oct. 2, 2014

(86) PCT No.: PCT/KR2014/009325
§ 371 (c)(1),
(2) Date: Mar. 15, 2016

(87) PCT Pub. No.: WO2015/050397
PCT Pub. Date: Apr. 9, 2015

(65) Prior Publication Data

US 2016/0222572 A1 Aug. 4, 2016

(30) Foreign Application Priority Data

Oct. 2, 2013 (KR) ..... 10-2013-0118048
Oct. 2, 2014 (KR) ..... 10-2014-0133037

(51) Int. Cl.
*D06F 37/40* (2006.01)
*D06F 37/30* (2006.01)
*D06F 37/36* (2006.01)

(52) U.S. Cl.
CPC ..... *D06F 37/40* (2013.01); *D06F 37/304* (2013.01); *D06F 37/36* (2013.01)

(58) Field of Classification Search
CPC ..... D06F 37/40; D06F 37/304; D06F 37/36
See application file for complete search history.

(56) References Cited

U.S. PATENT DOCUMENTS 6,257,027 B1 * 7/2001 Imai ..... D06F 37/304 68/12.12
2002/0007653 A1 * 1/2002 Koshiga ..... D06F 37/304 68/23.7

(Continued)

FOREIGN PATENT DOCUMENTS

JP 2006043153 A * 2/2006
KR 20040056016 6/2004

(Continued)

OTHER PUBLICATIONS

Machine translation of JP 2006-043153 A, no date.*
International Search Report—PCT/KR2014/009325 dated Jan. 27, 2015.

*Primary Examiner* — Joseph L. Perrin
(74) *Attorney, Agent, or Firm* — Cantor Colburn LLP

(57) ABSTRACT

Provided is a washing machine motor including: an outer rotor connected with an outer shaft; an inner rotor connected with an inner shaft; a stator disposed with an air gap between the inner rotor and the outer rotor and driving the inner rotor and the outer rotor independently; and a planetary gear set provided in the inner shaft to thus decelerate a rotational speed of the inner shaft. The outer shaft is rotated at the same speed as that of the outer rotor, and the inner shaft is decelerated compared to the rotational speed of the inner rotor, so as to increase the torque of the inner shaft. The washing machine motor enables a small-torque output from the inner rotor to drive the pulsator through a planetary gear set and a large-torque output from the outer rotor to drive the wash tub through the planetary gear set.

12 Claims, 7 Drawing Sheets

(56) References Cited

U.S. PATENT DOCUMENTS

| | | | | |
|---|---|---|---|---|
| 2004/0168485 | A1* | 9/2004 | Lim | D06F 37/304 68/24 |
| 2006/0010612 | A1* | 1/2006 | Kim | D06F 37/36 8/158 |
| 2006/0042022 | A1* | 3/2006 | Kim | D06F 37/304 8/159 |
| 2009/0115278 | A1* | 5/2009 | Choi | D06F 37/304 310/156.12 |
| 2010/0050702 | A1* | 3/2010 | Kim | D06F 37/304 68/23 R |
| 2013/0160499 | A1* | 6/2013 | Kim | A47L 15/0018 68/12.16 |

FOREIGN PATENT DOCUMENTS

| | | |
|---|---|---|
| KR | 100548310 | 1/2006 |
| KR | 20060006418 | 1/2006 |
| KR | 20060020266 | 3/2006 |
| KR | 20060086661 | 8/2006 |
| KR | 101228043 | 1/2013 |
| KR | 20130074151 | 7/2013 |

* cited by examiner

WASHING MACHINE MOTOR AND WASHING MACHINE COMPRISING SAME

TECHNICAL FIELD

The present invention relates to a washing machine motor that may drive a washing tub and a pulsator independently, and a washing machine using the same.

BACKGROUND ART

As disclosed in Korean Patent Registration Publication No. 10-0548310 (which will be referred to as Patent Document 1), a conventional washing machine includes: an outer case forming an outer shape; an outer tub which is supported on an inside of the outer case and receives wash water therein; an inner tub which is rotatably accommodated in an inside of the outer tub and is used for both washing and dehydrating; a pulsator which is mounted relatively rotatably in an inside of the inner tub, to thus form a washing water flow; a drive motor for generating a driving force for rotating the inner tub and the pulsator; an inner tub rotating shaft which receives the driving force of the drive motor thereby rotating the inner tub; a pulsator rotating shaft which receives the driving force of the drive motor thereby rotating the pulsator; a sun gear which is connected to the drive motor and is connected to the pulsator rotating shaft; a plurality of planetary gears which are simultaneously engaged with both the sun gear and a ring gear; a carrier supporting the planetary gears so as to be rotated and revolved; and a clutch spring for controlling the rotation of the inner tub and the pulsator during washing or dehydrating.

The conventional washing machine disclosed in Patent Document 1 has a planetary gear set including the sun gear, the ring gear, the planetary gears and the carrier, and reduces the rotational force of the drive motor, to then be transferred to the pulsator and the inner tub, and operates the clutch spring to selectively transmit power to the pulsator and the inner tub, to thus rotate only the pulsator during washing or to thus rotate both the pulsator and the inner tub simultaneously during dehydrating.

However, the conventional washing machine needs the planetary gear set and the clutch in order to selectively rotate the pulsator and the inner tub, to accordingly cause the configuration of the conventional washing machine to be complicated and the production cost thereof to increase.

Further, since the conventional washing machine is configured to have the planetary gear set and the clutch spring between the drive motor and the outer tub, the space occupied in the height direction of the washing machine is increased and thus the height of the washing machine increases. Otherwise, since the height of the inner tub should be reduced in an identical height of the washing machine, there is a problem that a washing capacity is reduced.

Furthermore, when the pulsator rotating shaft is rotated in only one direction where the clutch spring is compressed upon dehydration of the conventional washing machine, the clutch spring is tightened to the outer peripheral surfaces of a first clutch drum and a second clutch drum, whereby the pulsator rotating shaft and the inner tub rotating shaft are integrally rotated in an identical direction at an identical speed by the tension of the clutch spring. In this case, conventionally, a bearing rotatable only in one direction is used as a bearing for supporting the planetary gear set.

As a result, since the conventional washing machine disclosed in Patent Document 1 has a structure that the pulsator and the inner tub may be rotated only in an identical direction, but may not be rotated in opposite directions to each other, there is a problem that a variety of wash water flows may not be formed and there is a limit to improve performance of the washing machine.

In addition, another conventional washing machine motor is configured to rotate only the pulsator in a state of braking the inner tub during washing and to rotate both the pulsator and the inner tub at the same time during dehydrating.

Meanwhile, Korean Patent Application Publication No. 10-2012-0136081 (which will be referred to as Patent Document 2) disclosed a driving apparatus for a direct drive type washing machine, the driving apparatus including: a dehydrating tank rotating shaft which is rotatably supported on a support member and is connected to a dehydrating tank, to thus rotate the dehydrating tank; a pulsator rotating shaft which is rotatably disposed in an inside of the dehydrating tank rotating shaft and is connected to a pulsator, to thus rotate the pulsator; an inner rotor which is connected to the dehydrating tank rotating shaft; an outer rotor which is connected to the pulsator rotating shaft; and a double stator which is disposed with an air gap between the inner rotor and the outer rotor, to thereby form a magnetic circuit together with each of the inner rotor and the outer rotor.

However, the driving apparatus disclosed in Patent Document 2 is configured to rotate the dehydrating tank through the dehydrating tank rotating shaft by the inner rotor, and to rotate the pulsator by the pulsator rotating shaft by the outer rotor. Thus, the inner rotor is designed to have a high-speed, low-torque characteristic of about 1000 rpm and 3 Nm to fit a dehydration mode, and the outer rotor is designed to have a low-speed, high-torque characteristic of about 100 rpm and 15 Nm to fit a washing mode.

Thus, when the pulsator and the washing tub are intended to be driven in opposite directions to each other by rotating the inner rotor and the outer rotor in opposite directions to each other so as to form various water flow patterns in a washing mode, and since the inner rotor is designed to have a high-speed, low-torque characteristic in the washing mode, there occurs a problem that the torque is small and the current is increased in the case that the inner rotor is applied to the washing mode. In particular, since the washing machine having the washing capacity of a 8 Kg class is required to have a high-torque of 15 Nm or so, and the washing machine of the washing capacity of a 13 Kg class is required to have a high-torque of 40 Nm or so, a large-capacity washing machine of the 8 Kg class or higher has a problem of a temperature rise due to a current density increase with decreased efficiency.

Technical Problem

To solve the above problems or defects, it is an object of the present invention to provide a washing machine motor that provides a dual-power while having a double rotor-double stator structure, to thereby independently drive a pulsator and a washing tub, respectively, and eliminate an existing clutch mechanism to thus simplify the structure of the washing machine motor and to thereby enable the pulsator and the washing tub to be mutually reversely driven, and a washing machine having the same.

It is another object of the present invention to provide a washing machine motor independently driving a pulsator and a washing tub, respectively, and setting a planetary gear set to be rotatable in two-way directions, to thereby enable dual-power and mono-power implementations and form a variety of water flow patterns, and a washing machine having the same.

It is still another object of the present invention to provide a washing machine motor enabling torque conversion by shifting a rotational speed of an inner shaft so as to be appropriate for a large-capacity washing machine, and a washing machine having the same.

It is yet another object of the present invention to provide a washing machine motor enabling a laundry by using reverse driving of a pulsator and a washing tub, to thus form a variety of wash water flows and implement a large-capacity washing machine, in which an outer rotor is connected to the washing tub, and an inner rotor is connected to the pulsator, to thus cause a small-torque output from the inner rotor to drive the pulsator through a planetary gear set and a large-torque output from the outer rotor to drive the wash tub through the planetary gear set without shifting a rotational speed of the motor, and a washing machine having the same.

It is still yet another object of the present invention to provide a washing machine motor in which a planetary gear set is disposed in a motor internal space that is given due to removal of a conventional clutch apparatus, to thus reduce height of the motor as compared to the conventional art, and a washing machine having the same.

The objects of the present invention are not limited to the above-described objects, and other objects and advantages of the present invention may be appreciated by the following description and will be understood more clearly by embodiments of the present invention.

Technical Solution

To accomplish the above and other objects of the present invention, according to an aspect of the present invention, there is provided a washing machine motor comprising: an outer rotor which is connected to a washing tub via an outer shaft; an inner rotor which is connected to a pulsator via an inner shaft; and a stator which is disposed with an air gap between the inner rotor and the outer rotor, and which drives the inner rotor and the outer rotor independently, wherein the outer shaft is rotated at the same speed as that of the outer rotor, and the inner shaft is decelerated compared to the rotational speed of the inner rotor so as to increase torque of the inner shaft.

Preferably but not necessarily, the outer shaft comprises: a first outer shaft connected to the outer rotor; and a second outer shaft connected to the washing tub, and the inner shaft comprises: a first inner shaft connected to the inner rotor, and a second inner shaft connected to the pulsator.

Preferably but not necessarily, a planetary gear set is provided between the first inner shaft and the second inner shaft in order to decelerate the rotational speed.

Preferably but not necessarily, the planetary gear set comprises: a ring gear coupling the first outer shaft and the second outer shaft; a sun gear coupled to the first inner shaft; and a carrier to which planetary gears are rotatably supported and that is connected to the second inner shaft, in which the planetary gears are engaged with an outer surface of the sun gear and an inner surface of the ring gear.

Preferably but not necessarily, the planetary gear set is disposed in an inner space portion of the inner rotor.

Preferably but not necessarily, the inner rotor comprises: a first magnet which is disposed with a certain gap on an inner surface of the stator; a first back yoke which is disposed on a rear surface of the first magnet; and an inner rotor support to which the first magnet and the first back yoke are fixed, and which is connected to the inner shaft.

Preferably but not necessarily, the outer rotor comprises: a second magnet which is disposed with a certain gap on an outer surface of the stator; a second back yoke which is disposed on a rear surface of the second magnet; and an outer rotor support to which the second magnet and the second back yoke are fixed, and which is connected to the outer shaft.

Preferably but not necessarily, the stator comprises: a plurality of stator cores that are made of a split type and assembled and arranged in an annular form; bobbins that are wrapped on respective outer circumferential surfaces of the plurality of stator cores; a first coil wound on one side of each of the stator cores; a second coil wound on the other side of each of the stator cores; and a stator support in which the plurality of stator cores are arranged and integrated in an annular shape and that is fixed to a bearing housing.

Preferably but not necessarily, the plurality of stator cores are made in an integral form.

Preferably but not necessarily, the stator support is integrally formed with the plurality of stator cores by insert molding.

According to another aspect of the present invention, there is provided a washing machine motor comprising: an outer rotor connected with an outer shaft; an inner rotor connected with an inner shaft which is coaxially disposed in an inside of the outer shaft; a double stator which is disposed with an air gap between the inner rotor and the outer rotor and which drives the inner rotor and the outer rotor independently; and a planetary gear set that is provided in the inner shaft to thus decelerate a rotational speed of the inner shaft.

According to another aspect of the present invention, there is provided a washing machine comprising: an outer tub that accommodates wash water; a washing tub rotatably disposed inside the outer tub to thus perform washing and dehydrating; a pulsator rotatably disposed inside the washing tub to thus form wash water flows; and a washing machine motor that independently rotatably drives the washing tub and the pulsator, wherein the washing machine motor comprises: an outer rotor connected with an outer shaft; an inner rotor connected with an inner shaft; a stator which is disposed with an air gap between the inner rotor and the outer rotor and which drives the inner rotor and the outer rotor independently; and a planetary gear set that is provided in the inner shaft to thus decelerate a rotational speed of the inner shaft, wherein the outer shaft is rotatably supported in two-way directions.

Preferably but not necessarily, the pulsator and the washing tub of the washing machine are driven in different directions and at different speeds from each other, so as to form strong wash water flows in a pattern form.

Preferably but not necessarily, the pulsator and the washing tub of the washing machine are driven in different directions from each other and at an identical speed to each other, so as to form strong wash water flows to heighten a cleaning capability.

Preferably but not necessarily, the pulsator and the washing tub of the washing machine are driven at a variable speed so as to form rhythmic water flows.

Preferably but not necessarily, the pulsator and the washing tub of the washing machine are driven in an identical direction to each other and at different speeds from each other, so as to form a vortex to prevent damage to the laundry.

Preferably but not necessarily, the pulsator and the washing tub of the washing machine are driven in variable speed, to thus form rhythmic water flows.

Preferably but not necessarily, the washing machine further comprises first and second bearings that are both provided in the outer shaft and that respectively rotatably support the outer shaft and the planetary gear in two-way directions.

Advantageous Effects

As described above, a washing machine motor according to the present invention is configured to independently drive a pulsator and a washing tub, respectively, to thus remove an existing clutch mechanism to thereby simplify a structure, and to thus enable the pulsator and the washing tub to be reversely driven to thereby form a variety of wash water flows.

In addition, a washing machine motor according to the present invention is configured to independently drive a pulsator and a washing tub, respectively, to thus enable dual-power and mono-power implementations and form a variety of water flow patterns, to thereby improve performance of a washing machine such as improvement of a cleaning capability and shortening of a laundry time.

Further, a washing machine motor according to the present invention is configured to employ a planetary gear set in an inner shaft connected to a pulsator, to thus decelerate a speed of the inner shaft to increase a torque to thereby implement a large-capacity washing machine.

In addition, a washing machine motor according to the present invention is configured to connect an outer rotor to a washing tub and connect an inner rotor to a pulsator, to thus cause a large-torque outer rotor to rotate the washing tub, to thereby improve performance of a washing machine.

That is, the washing machine motor according to the present invention enables a small-torque output from the inner rotor to drive the pulsator through a planetary gear set and a large-torque output from the outer rotor to drive the wash tub through the planetary gear set without shifting a rotational speed of the motor, thereby enabling a laundry by using reverse driving of a pulsator and a washing tub, to thus form a variety of wash water flows and implement a large-capacity washing machine.

BEST MODE

Figure 1:
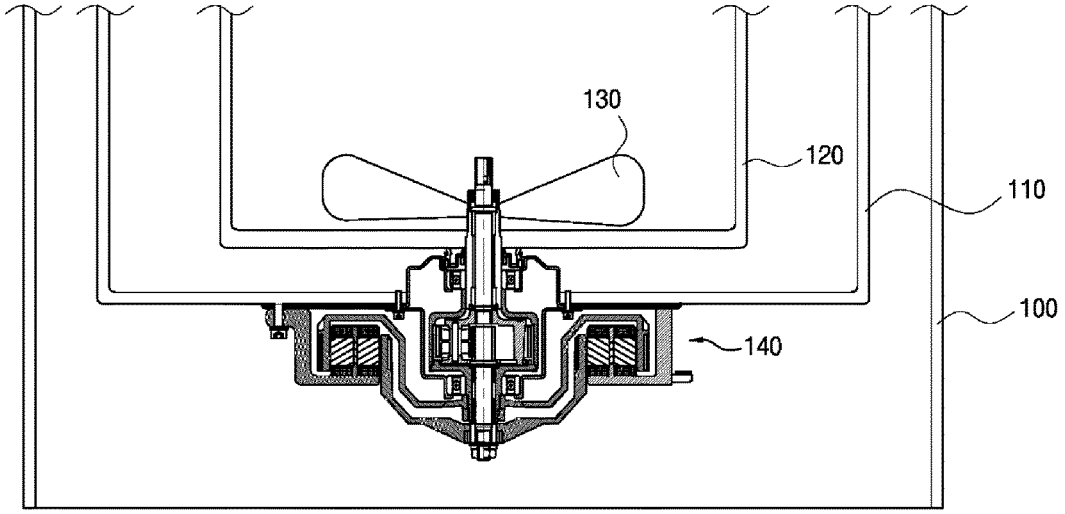
FIG. 1 is a cross-sectional view of a washing machine according to an embodiment of the present invention.

Hereinafter, embodiments of the present invention will be described in detail with reference to the accompanying drawings. In the process, the size and shape of the components illustrated in the drawings may be shown exaggerated for convenience and clarity of explanation. Further, by considering the configuration and operation of the present invention the specifically defined terms may be changed according to user's or operator's intention, or the custom. Definitions of these terms herein need to be made based on the contents across the whole application.

Figure 2:
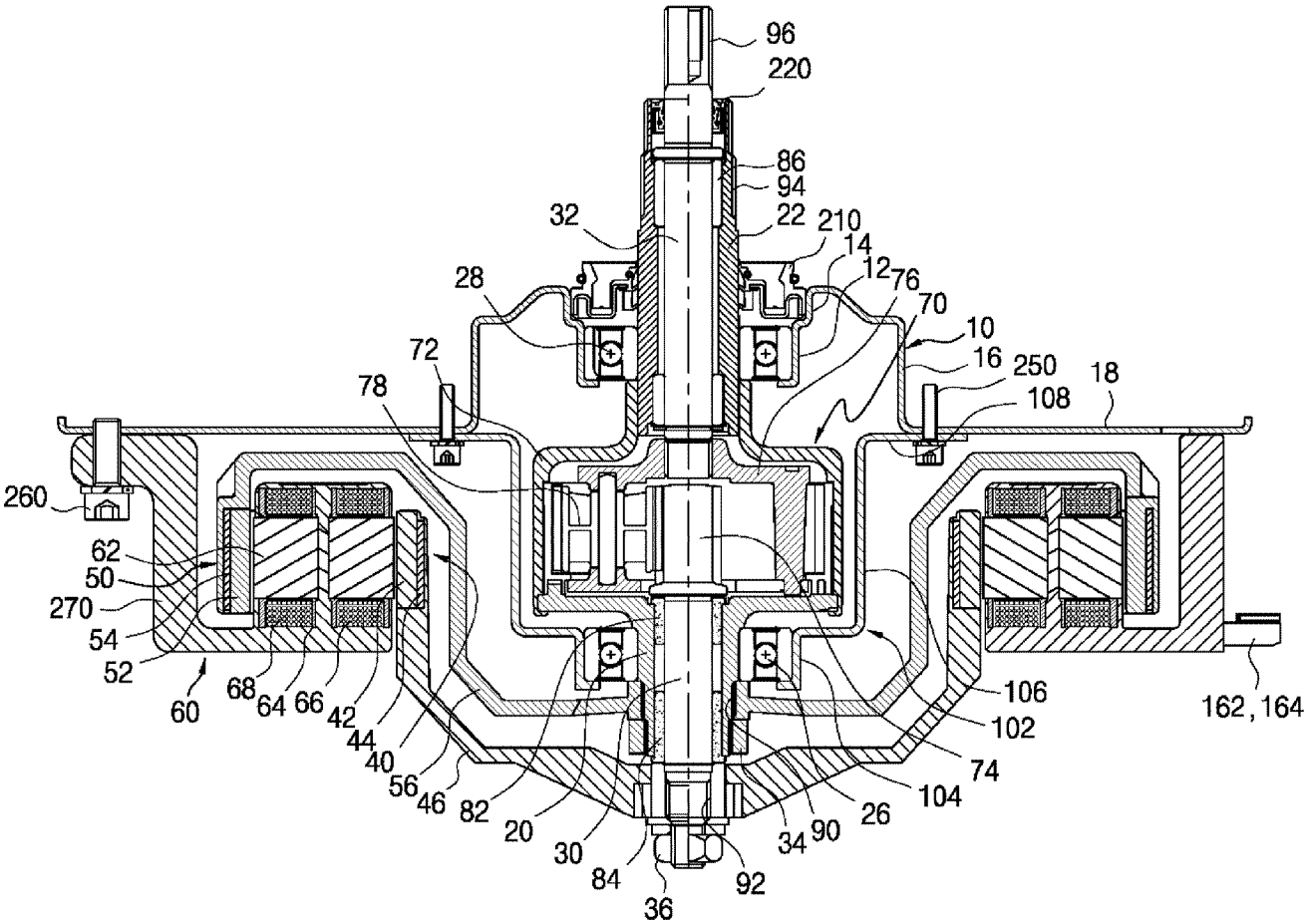
FIG. 2 is a cross-sectional view of a washing machine motor according to an embodiment of the present invention.

FIG. 1 is a cross-sectional view of a washing machine according to an embodiment of the present invention, and FIG. 2 is a cross-sectional view of a washing machine motor according to an embodiment of the present invention.

Referring to FIGS. 1 and 2, a washing machine according to an embodiment of the present invention includes: a case 100 forming an outer appearance; an outer tub 110 which is disposed in an inside of the case 100 and accommodating washing water; a washing tub 120 which is rotatably disposed inside the outer tub 110 to perform washing and dehydrating; a pulsator 130 which is rotatably disposed inside the washing tub 120 to form washing water flows; and a washing machine motor 140 which is mounted on a lower portion of the washing tub 120, to drive the washing tub 120 and the pulsator 130 simultaneously or selectively.

As shown in FIG. 2, the washing machine motor 140 includes: outer shafts 20 and 22 connected to the washing tub 120; inner shafts 30 and 32 rotatably disposed inside the outer shafts 20 and 22 and connected to the pulsator 130; an outer rotor 50 connected to the outer shafts 20 and 22; an inner rotor 40 connected to the inner shafts 30 and 32; a stator 60 disposed between the inner rotor 40 and the outer rotor 50 with an air gap; and a planetary gear set 70 mounted on the inner shafts 30 and 32 so as to reduce the rotational speeds of the inner shafts 30 and 32 and increase the torque thereof.

The outer shafts 20 and 22 are formed in a cylindrical shape so that the inner shafts 30 and 32 pass through the outer shafts 20 and 22, respectively, and include a first outer shaft 20 coupled to the inner rotor 40, and a second outer shaft 22 coupled to the washing tub 120.

Then, the inner shafts 30 and 32 include a first inner shaft 30 coupled to the outer rotor 50 and a second inner shaft 32 coupled to the pulsator 130.

Figure 3:
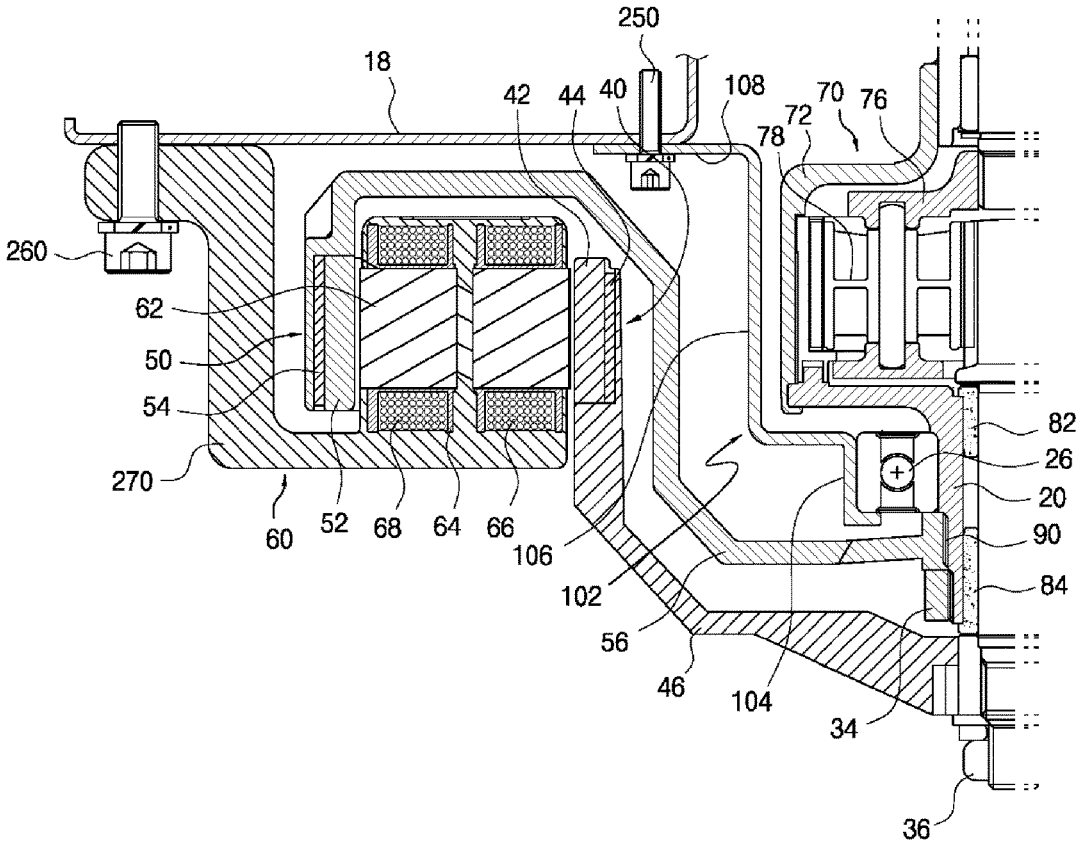
FIG. 3 is a cross-sectional view of a planetary gear set according to an embodiment of the present invention.

As shown in FIG. 3, the planetary gear set 70 includes: a ring gear 72 connecting between the first outer shaft 20 and the second outer shaft 22; a sun gear 74 integrally coupled to the first inner shaft 30; a plurality of planetary gears 78 engaged with an outer surface of the sun gear 74 and an inner surface of the ring gear 72; and a carrier 76 to which the plurality of planetary gears 78 are rotatably supported and that is connected to the second inner shaft 32.

The planetary gear set 70 is configured so that the first outer shaft 20 and the second outer shaft 22 are connected by the ring gear 72 and thus the rotational speed of the first outer shaft 20 is transferred to the second outer shaft 22. Therefore, the rotational speed of the first outer shaft 20 is the same as that of the second outer shaft 22.

In addition, the first inner shaft 30 is formed integrally with the sun gear 74, and the second inner shaft 32 is spline-coupled with the carrier 76. The carrier 76 is rotatably supported in the center of the planetary gears 78. As a result, the rotational speed of the first inner shaft 30 is decelerated to then be transmitted to the second inner shaft 32.

In this way, the inner shafts 30 and 32 are interconnected via the planetary gear set 70 to thus decelerate the rotational speed of the inner rotor 40 to then be transmitted to the pulsator 130, to thereby increase the torque of the pulsator 130 and accordingly be applicable to a large-capacity washing machine.

A first sleeve bearing 80 and a second sleeve bearing 82 are respectively provided in a cylindrical form between an outer circumferential surface of the first inner shaft 30 and an inner circumferential surface of the first outer shaft 20, to thus rotatably support the first inner shaft 30.

A third sleeve bearing 84 and a fourth sleeve bearing 86 are provided on upper and lower inner surfaces of the second outer shaft 22, respectively, to thus rotatably support the second inner shaft 32.

A first link 90 to which an outer rotor support 56 of the outer rotor 50 is connected is formed on an outer surface of the first outer shaft 20 and a second link 92 to which an inner rotor support 46 of the inner rotor 40 is connected is formed on a lower end of the first inner shaft 30.

The first link 90 and the second link 92 may be serration-coupled or spline-coupled through protrusions formed on the outer surfaces of the first outer shaft 20 and the first inner shaft 30, or mutually key-coupled through key grooves formed on the outer surfaces of the first outer shaft 20 and the first inner shaft 30.

Here, a first locking nut 34 is screwed and coupled at the lower end of the first outer shaft 20, in which the first locking nut 34 prevents the departure of the outer rotor support 56 of the outer rotor 50 from the first outer shaft 20, and a second locking nut 36 is screwed and coupled at the lower end of the first inner shaft 30, in which the second locking nut 36 prevents the departure of the inner rotor support 46 of the inner rotor 50 from the first inner shaft 30.

A third link 94 is formed on the upper outer surface of the second outer shaft 22 in which the washing tub 120 is connected to the third link 94, and a fourth link 96 is formed on the upper outer surface of the second inner shaft 32 in which the pulsator 130 is connected to the fourth link 96.

The third link 94 and the fourth link 96 may be serration-coupled or spline-coupled through protrusions formed on the outer surfaces of the second outer shaft 22 and the second inner shaft 32, or mutually key-coupled through key grooves formed on the outer surfaces of the second outer shaft 22 and the second inner shaft 32.

A first seal 220 is mounted between the second outer shaft 22 and the second inner shaft 32 to prevent the washing water from leaking, and a second seal 210 is mounted between the second outer shaft 22 and a bearing housing 10 to prevent the washing water from leaking.

A first bearing 26 is disposed on the outer surface of the first outer shaft 20, to thus rotatably support the first outer shaft 20 and a second bearing 28 is disposed on the outer surface of the second outer shaft 22, to thus rotatably support the second outer shaft 22.

The first bearing housing 102 is formed of a metallic material, and includes: a first bearing mount portion 104 in which the first bearing 26 is mounted; a cover portion 106 that is extended outwardly from the first bearing mount portion 104 to thus form a cylindrical shape, and that is disposed with a predetermined gap to wrap around the outer surface of the planetary gear set 70 to protect the planetary gear set 70; a stator 60 that is extended outwardly from the top of the cover portion 106 to thus form a circular plate; and a flat plate portion 108 to which the outer tub 110 is fixed.

The flat plate portion 108 is coupled with the second bearing housing 10 with bolts 250 in the circumferential direction of the flat plate portion 108.

The second bearing housing 10 is formed of a metallic material, and includes: a second bearing mount portion 12 in which the second bearing 28 is mounted; a second seal fastener 14 that is extended outwardly from the second bearing mount portion 12 to thus fasten the second seal 210; a link 16 that is bent downwardly from the second seal fastener 14 to thus form a cylindrical shape; and a flat plate portion 18 that is extended outwardly from a lower end of the link 16 to thus be fixed to the outer tub 110.

The flat plate portion 18 is coupled with the flat plate portion 108 of the first bearing housing 102 with bolts 250, and is fixed to a stator support 270 and the outer tub 110.

Figure 4:
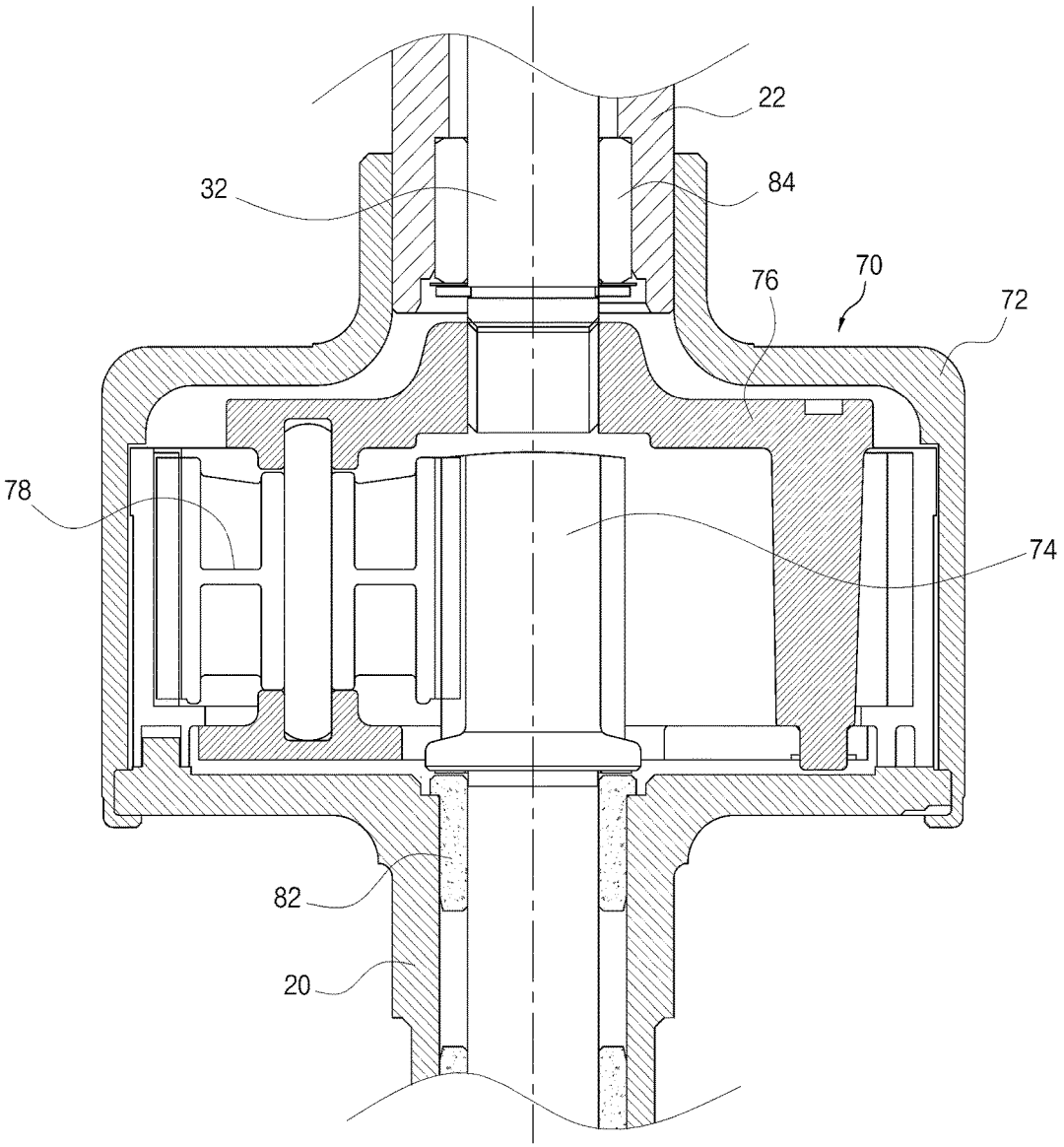
FIG. 4 is a cross-sectional view of a stator according to an embodiment of the present invention.

As shown in FIG. 4, the inner rotor 40 includes: a plurality of first magnets 42 that are disposed on the inner surface of the stator 60 with a certain gap; a first back yoke 44 disposed on the rear surfaces of the plurality of first magnets 42; and an inner rotor support 46 that is integrally formed with the first magnets 42 and the first back yoke 44 by an insert molding method.

Here, the inner rotor support 46 is integrally formed with the plurality of first magnets 42 and the first back yoke 44 by molding a thermosetting resin, for example, a BMC (Bulk Molding Compound) molding material such as polyester. Thus, the inner rotor 40 may have waterproof performance, and shorten the manufacturing process.

The inner surface of the inner rotor support 46 is connected to the second link 92 of the first inner shaft 30, and the first magnet 42 and the first back yoke 44 are fixed to the outer surface thereof.

Therefore, when the inner rotor 40 rotates, the inner shafts 30 and 32 are rotated, and the pulsator 130 that is connected to the inner shafts 30 and 32 is rotated.

Here, the pulsator 130 may be fully rotated by the torque of the inner rotor 40 due to the rotational torque that is not large.

Then, the outer rotor 50 includes: a plurality of second magnets 52 that are disposed on the outer surface of the stator 60 with a certain gap; a second back yoke 54 disposed on the rear surface of the plurality of the second magnets 52; and an outer rotor support 56 that is integrally formed with the second magnets 52 and the second back yoke 54 by an insert molding method.

Here, the outer rotor support 56 is integrally formed with the plurality of second magnets 52 and the second back yoke 54 by molding a thermosetting resin, for example, a BMC (Bulk Molding Compound) molding material such as polyester. Thus, the outer rotor 50 may have waterproof performance, and shorten the manufacturing process.

The inner surface of the outer rotor support 56 is connected to the first link 90 of the first outer shaft 20 and the outer rotor support 56 is rotated with the first outer shaft 20, and the second magnet 52 and the second back yoke 54 are fixed to the outer surface thereof.

Therefore, when the outer rotor 50 rotates, the outer shafts 20 and 22 are rotated, and the washing tub 120 associated with the outer shafts 20 and 22 is rotated.

The torque of the outer rotor 50 is larger than that of the inner rotor 40. Then, a larger torque is needed in order to rotate the washing tub 120, when compared with the torque needed to rotate the pulsator 130.

In this way, the washing machine motor according to the embodiment is configured so that the outer rotor 50 having a large torque is connected to the washing tub 120 that requires a large torque, to thereby realize a high-capacity washing machine.

Figure 5:
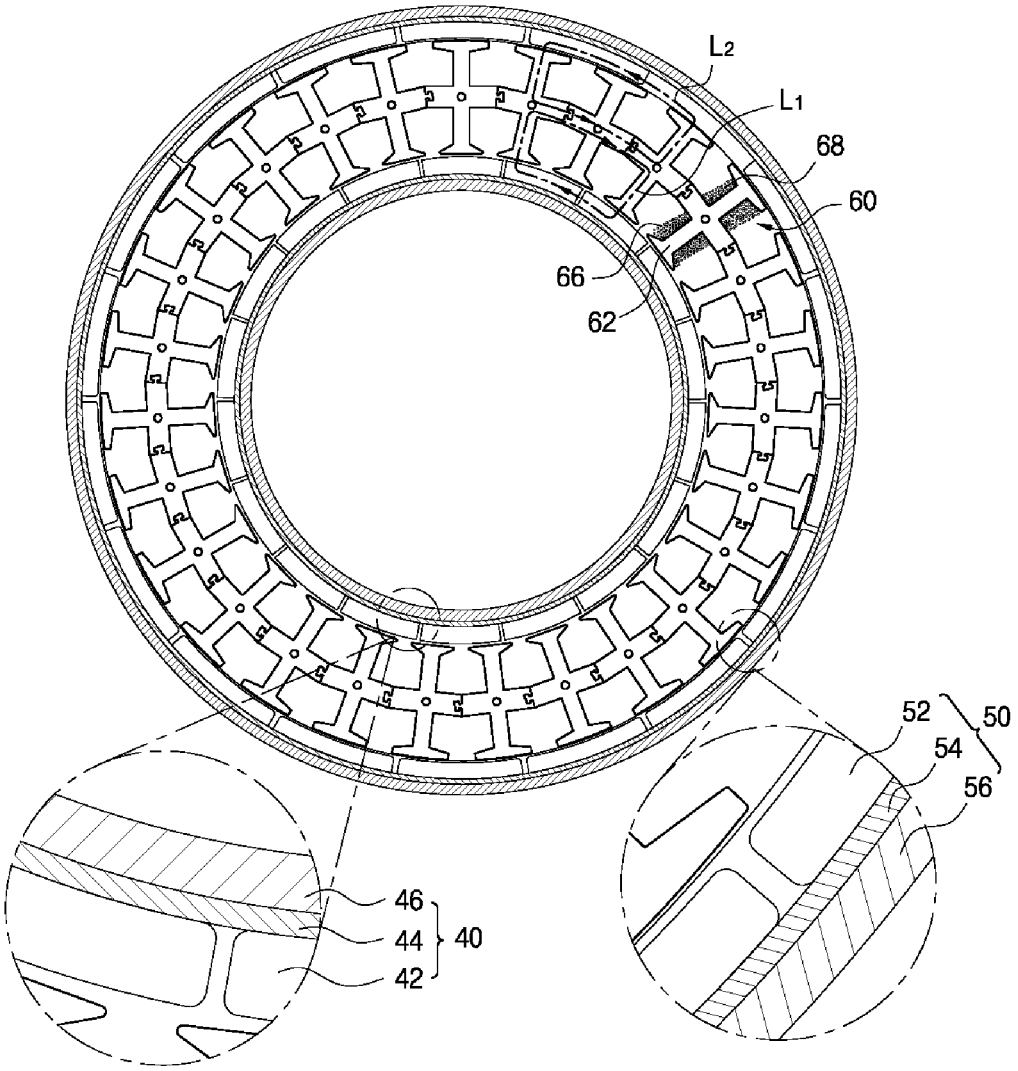
FIG. 5 is a horizontal cross-sectional view of a washing machine motor according to an embodiment of the present invention.
Figure 6:
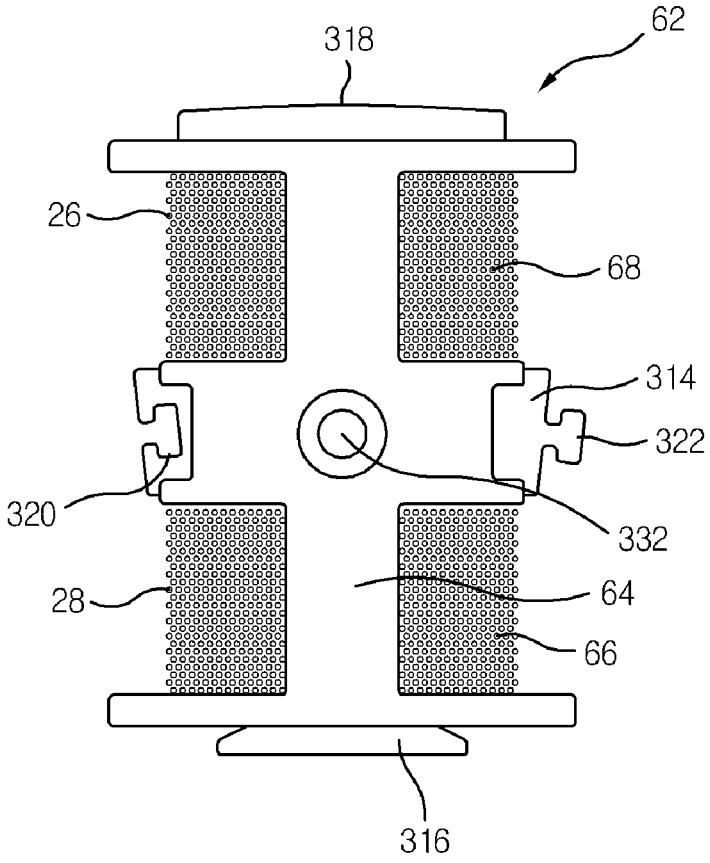
FIG. 6 is a cross-sectional view of a stator according to an embodiment of the present invention.
Figure 7:
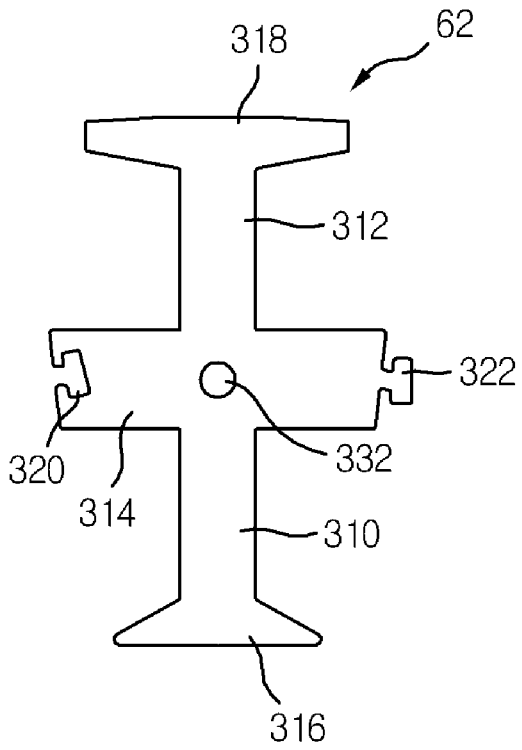
FIG. 7 is a cross-sectional view of a stator core according to an embodiment of the present invention.

FIG. 5 is a horizontal cross-sectional view of a washing machine motor according to an embodiment of the present invention, FIG. 6 is a schematic cross-sectional view of a split-type stator according to an embodiment of the present invention, and FIG. 7 is a cross-sectional view of a stator core according to an embodiment of the present invention.

As shown in FIGS. 3 and 5, the stator 60 includes: a plurality of split-type stator cores 62 that are arranged in an annular shape; non-magnetic bobbins 64 that are configured to wrap the outer circumferential surfaces of the plurality of stator cores 62, respectively; a first coil 66 that is wound on one side of each of the stator cores 62; a second coil 68 that is wound on the other side of each of the stator cores 62; and a stator support 270 in which the plurality of stator cores 62 are arranged in an annular shape and that is fixed to the outer tub 110.

The stator support 270 is integrally formed with the stator cores 62 by an insert molding method after arranging the plurality of split-type stator cores 62 at certain intervals in an annular form in the circumferential direction thereof in a mold.

In other words, the stator support 270 is molded by the insert molding method by molding a thermosetting resin, for example, a BMC (Bulk Molding Compound) molding material such as polyester. In this case, the plurality of stator cores 62 are arranged at certain intervals in an annular form in the circumferential direction thereof in a mold, and thus are integrally formed.

Other than the structure that the stator support 270 is integrally formed with the stator cores 62 by insert molding, the stator support 270 may be separately manufactured from the stator cores 62 and then coupled with the stator cores 62 by using bolts.

As shown in FIGS. 6 and 7, the stator core 62 includes: a first tooth portion 310 around which the first coil 66 is wound; a second tooth portion 312 that is formed on the other side of the first tooth portion 310 and around which the second coil 68 is wound; a partition 314 for partitioning between the first tooth portion 310 and the second tooth portion 312; and couplers 320 and 322 formed on both lateral ends of the partition 314 and interconnecting between the adjoining stator cores 62.

In the above embodiment, the plurality of stator cores 62 made of a split type are assembled in an annular form to thus form a stator core body, and are integrated by the stator support 270, but the stator core body may be formed of a one-piece.

Here, a first output of a first inverter 530 is applied to the first coil 66 and a second output of a second inverter 540 is applied to the second coil 68. Accordingly, when the first output is applied to only the first coil 66, only the inner rotor 40 is rotated, when the second output is applied to only the second coil 68, only the outer rotor 50 is rotated, and when the first output and the second output are applied to the first coil 66 and second coil 68, respectively, both the inner rotor 40 and outer rotor 50 are rotated.

A throughhole 332 is formed at the center of the partition 314, to thus serve to prevent a first magnetic circuit formed by the first coil 66 and a second magnetic circuit formed by the second coil 68 from being interfered with each other. The throughhole 332 may be formed in a circular shape, but may be formed long in a slot type in the lateral direction of the partition 314.

A first flange 316 is formed at the end of the first tooth portion 310 so as to be disposed to face the first magnets 42 and a second flange 318 is formed at the end of the second tooth portion 312 so as to be disposed to face the second magnets 52.

The first flange 316 and the second flange 318 are formed to have inward and outward curved surfaces at predetermined curvatures, respectively, to correspond to the first magnet 42 of the inner rotor 40 and the second magnet 52 of the outer rotor 50. Thus, the roundness of the inner circumferential surface and the outer circumferential surface of the stator core 62 is increased and thus certain magnetic gaps may be maintained between the inner circumferential surface of the stator 60 and the first magnet 42 and between the outer circumferential surface of the stator 60 and the second magnet 52, respectively, although the inner circumferential surface and outer circumferential surface of the stator 60 are proximate to the first magnet 42 and the second magnet 52.

The plurality of stator cores 62 should have a structure of being directly connected to each other so as to form a magnetic circuit. Thus, the couplers 320 and 322 of one stator core 62 have a structure of being directly connected to the couplers 322 and 320 of another adjacent stator core 62 so that the stator cores 62 may be energized.

As an example, these couplers 320 and 322 are configured so that a coupling protrusion 322 is protrudingly formed at one side of the partition 314 and a coupling groove 320 with which a coupling protrusion 322 of a neighboring stator core 62 is fitted and coupled is formed at the other side of the partition 314. Thus, when the coupling protrusion 322 of one state core is fitted into and coupled with the coupling groove 320 of a neighboring stator core, the stator cores 62 are annularly arranged, and have a directly cross-linked structure that the stator cores 62 are directly connected with each other.

In addition to the above structure, the couplers have a structure that pinholes are formed at both end portions of the partition of each of the stator cores, and a pin member is fitted into and coupled with the pinholes of two stator cores at a state where the stator cores 62 contact each other, to thereby employ a structure of connecting between the stator cores. Alternatively, the couplers may employ a method of caulking the stator cores by using a caulking member in a state where the stator cores contact each other.

As shown in FIG. 2, connectors 162 and 164 are mounted on the outside of the stator support 270, in which the connectors 162 and 164 are provide to apply the first output of the first inverter 530 and the second output of the second inverter 540 to the first coil 66 and second coil 68, respectively. The connectors 162 and 164 include a first connector 162 to which the first output of the first inverter 530 applied to the first coil 66 is connected in order to rotate the washing tub 120, and a second connector 164 to which the second output of the second inverter 540 applied to the second coil 68 is connected in order to rotate the pulsator 130.

Here, the first connector 162 and the second connector 164 are integrally formed at the time of insert injection molding the stator support 270. In other words, when the first connector 162 and the second connector 164 are placed in a mold and are subjected to insert molding, the first connector 162 and the second connector 164 are integrally formed on the stator support 270.

The washing machine driving apparatus including the washing machine motor 140 according to an embodiment of the present invention forms a first magnetic circuit $L_1$ between the inner rotor 40 and one side of the stator 60 where the first coil 66 is wound, and forms a second magnetic circuit $L_2$ between the outer rotor 50 and the other side of the stator 60 where the second coil 68 is wound, to thus form a pair of magnetic circuits each independent to each other. As a result, the inner rotor 40 and the outer rotor 50 may be respectively driven separately.

More specifically, the first magnetic circuit $L_1$ includes the first magnet 42 of the N-pole, the first tooth portion 310 on which the first coil 66 is wound, an inner part of the partition 314, the adjacent first tooth portion 310, the first magnet 42 of the S-pole adjacent to the first magnet 42 of the N-pole, and the first back yoke 44.

In addition, the second magnetic circuit $L_2$ includes the second magnet 52 of the N-pole, the second teeth portion 312 facing the second magnet 52 of the N-pole and on which the second coil 68 is wound, an outer part of the partition 314, the adjacent second teeth portion 312, the second magnet 52 of the S-pole, and the second back yoke 54.

The function of the washing machine motor according to an embodiment of the present invention will now be described.

Figure 8:
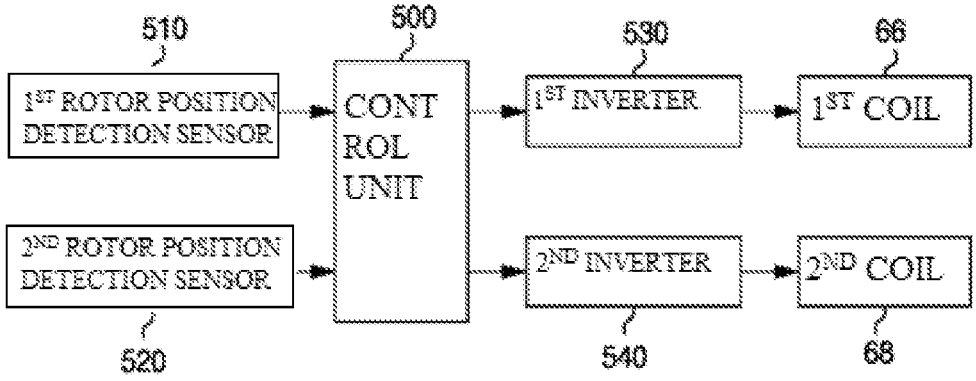
FIG. 8 is a block diagram of a washing machine control apparatus according to an embodiment of the present invention.

Referring to FIG. 8, a washing machine control apparatus according to an embodiment of the present invention includes: a first inverter 530 for generating a first drive signal applied to the first coil 66; a second inverter 540 for generating a second drive signal applied to the second coil 68, and a control unit 500 for controlling the first inverter 530, the second inverter 540 and the entire washing machine.

The control unit 500 is configured to play a role of a system control unit that serves to control the first and second inverters 530 and 540, and simultaneously the entire washing machine as described above, or is configured to function as a driver dedicated control unit that receives a washing control signal that is determined according to a washing course set by a user from a system control unit of a main body of a washing machine and then applies individual control signals to the first and second inverters 530 and 540 based on the washing control signal. The control unit 500 may be implemented by using a signal processor such as a microcomputer or a microprocessor.

According to an embodiment of the present invention, the washing machine motor 140 has a double rotor-double stator dual-power structure, in which the motor control thereof is performed by, for example, a U, V, W three-phase drive method. Therefore, the first and second coils 66 and 68 of the stator 60 are formed to include U, V, and W 3-phase coils, respectively. The first coil 66 wound on the first tooth portion 310 that is extended in the central direction of the stator 60 forms an inner stator, and the second coil 68 wound on the second tooth portion 312 that is extended in the radial direction thereof forms an outer stator.

As a result, the inner rotor 40 that is rotated by the inner stator forms an inner motor, and the outer rotor 50 that is rotated by the outer stator forms an outer motor. The motor structures of the inner motor and the outer motor are designed so as to be controlled in a BLDC method, respectively, and the first and second inverters 530 and 540 perform a drive control, for example, a six-step drive control method.

The first and second inverters 530 and 540 may be made of three pairs of switching transistors connected in a totem pole structure, respectively. The three-phase outputs from the respective inverters are applied to the U, V, W 3-phase coils of the first and second coils 66 and 68, respectively.

The control unit 500 that controls the first and second inverters 530 and 540 detects the rotational positions of the inner rotor 40 and the outer rotor 50 from first and second rotor position detection sensors 510 and 520, respectively, for example, Hall sensors and applies control signals of a PWM mode to the first and second inverters 530 and 540, respectively. In this case, the first and second inverters 530 and 540 apply the U, V, W 3-phase outputs to the U, V, W 3-phase coils of the first and second coils 66 and 68, respectively, to thereby rotatably drive the inner rotor 40 and the outer rotor 50.

Accordingly, the control unit 500 according to an embodiment of the present invention controls the first and second inverters 530 and 540 to thereby optionally and independently apply the outputs of the first and second inverters 530 and 540 to the first and second coils 66 and 68, respectively. Accordingly, the inner rotor 40 and the outer rotor 50 may be selectively and independently rotatably driven.

In addition, the planetary gear set 70 is configured so that the ring gear 72 is connected between the first and second outer shafts 20 and 22, and the first and second outer shafts 20 and 22 are rotatably supported in two-way directions by the first and second bearings 26 and 28 that are rotatable in two-way directions. Therefore, the planetary gear set 70 is also rotatably supported in two-way directions.

Thus, a washing machine according to an embodiment of the present invention employs the washing machine motor 140 having a double rotor-double stator structure, and adopts first and second inverters 530 and 540 to apply the U, V, W 3-phase outputs to the U, V, W 3-phase coils of the first and second coils 66 and 68 to rotatably drive the inner rotor 40 and the outer rotor 50.

As a result, the rotational forces of the inner rotor 40 and the outer rotor 50 are respectively applied to the pulsator 130 and the washing tub 120, through the inner shafts 30 and 32, the outer shafts 20 and 22, and the planetary gear set 70, to independently drive the pulsator 130 and the washing tub 120. In addition, the planetary gear set 70 is supported by the first and second bearings 26 and 28 both of which enable two-way rotation, to thereby control the rotational directions and the rotational speeds of the pulsator 130 and the washing tub 120, to thus form a variety of water flows.

Controlling the washing machine using the above-described washing machine motor 140 will be described as follows.

First, when only the pulsator 130 is driven during a washing operation, and power is applied to the first coil 66, the inner rotor 40 is rotated and the first inner shaft 30 connected to the inner rotor 50 is rotated. Then, the rotational speed of the inner rotor 40 is decelerated by the planetary gear set 70 coupled to the first inner shaft 30 to then be transmitted to the second inner shaft 32, and thus the pulsator 130 connected to the second inner shaft 32 is rotated.

In other words, when only the pulsator 130 is driven during a washing stroke, and a first output is applied from the first inverter 530 to the first coil 66, the inner rotor 40 is rotated and the first inner shaft 30 connected to the inner rotor 40 is rotated. Then, the rotational speed of the inner rotor 40 is decelerated while passing through the sun gear 74, the planetary gears 78, and the carrier 76 of the planetary gear set 70 coupled to the first inner shaft 30, and thus the pulsator 130 connected to the second inner shaft 32 is rotated.

In this way, the rotational speed of the inner rotor 40 is reduced while passing through the planetary gear set 70 and the torque thereof is increased to then be transmitted to the pulsator 130. Thus, the rotational speed of the pulsator 130 is reduced and torque thereof is increased. Accordingly, the washing machine motor according to the embodiment of the present invention may be applied to a large-capacity washing machine.

In addition, when only the washing tub 120 is driven to rotate, and a second output is applied from the second inverter 540 to the second coil 68, the outer rotor 50 is rotated and the first outer shaft 20 connected to the outer rotor 50 is rotated. The output from the first outer shaft 20 is transmitted to the second outer shaft 22 without deceleration while passing through the ring gear 72 of the planetary gear set 70. As a result, the washing tub 120 connected to the second outer shaft 22 is rotated without deceleration.

In this case, since the rotational force of the outer rotor 50 having a large torque is transmitted to the washing tub 120, it is easy to rotate the washing tub 120 that requires a large torque. Therefore, it is possible to raise the capacity of the washing machine, and it is also possible to implement a large capacity washing machine.

Further, when both the pulsator 130 and the washing tub 120 are simultaneously rotated in an identical direction, during a dehydration stroke and a rinsing stroke, the first and second inverter outputs are simultaneously applied to the first coil 66 and the second coil 68 from the first and second inverters 530 and 540, respectively. Then, the inner rotor 40 is rotated by the magnetic circuit $L_1$, and thus the inner shafts 30 and 32 associated with the inner rotor 40 are rotated, to thereby rotate the washing tub 120. Then, the outer rotor 50 is rotated by the magnetic circuit by $L_2$, and thus the outer shafts 20 and 22 connected to the outer rotor 50 are rotated to thereby rotate the pulsator 130. In this case, it is preferable to control the rotational speed of the washing tub 120 to be the same as that of the pulsator 130.

In addition, when the pulsator 130 and the washing tub 120 are reversely rotated to each other during a detangle stroke or in order to remove laundry tangle such as laundry jam, power is applied to the first coil 66 and the second coil 68 simultaneously, and the power applied to the first coil 66 and the power applied to the second coil 68 are each controlled independently, to thereby rotate the pulsator 130 and the washing tub 120 in opposite directions to each other while rotating the inner rotor 40 and the outer rotor 50 in opposite directions to each other.

In other words, when the pulsator 130 and the washing tub 120 are reversely rotated to each other for a washing stroke, a rinsing stroke, and a fabric detangle stroke for removing laundry tangle such as laundry jam, the inverter outputs are respectively applied to the first coil 66 and the second coil 68 simultaneously or with a time delay, and the first inverter output applied to the first coil 66 and the second inverter output applied to the second coil 68 are each controlled independently, to thereby rotate the pulsator 130 and the washing tub 120 in opposite directions to each other while rotating the inner rotor 40 and the outer rotor 50 in opposite directions to each other.

Further, a variety of wash water flows may be formed by rotating the pulsator 130 and the washing tub 120 in an identical direction at an identical speed, or in an identical direction at respectively different speeds, during a washing stroke and a rinsing stroke.

As described above, when driving the pulsator 130 and the washing tub 120 in different directions and at an identical speed, according to the embodiment of the present invention, it is possible to form strong washing water flows, and when driving the pulsator 130 and the washing tub 120 in different directions and at different speeds, it is possible to form various patterns of strong washing water flows.

In particular, when the pulsator 130 and the washing tub 120 are driven in different directions and at different speeds, strong vertical rising/falling water flows by the pulsator and a vortex by the washing tub are created, to thereby improve a cleaning capability and improve rinsing performance.

In some embodiments, the rotation speeds of the pulsator 130 and the washing tub 120 may vary to thereby form rhythm water flows, and to resultantly realize the rhythmic washing. That is, when the rotation speeds of the pulsator 130 and the washing tub 120 are controlled to be rapidly variable, strong water flows and rhythmic water flows may be formed to thereby prevent damage to the laundry.

In addition, the pulsator 130 and the washing tub 120 may be rotated with a time difference in an identical direction, to thus form a variety of wash water flows.

As described above, the present invention has been described with respect to particularly preferred embodiments. However, the present invention is not limited to the above embodiments, and it is possible for one of ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

The present invention may be applied to a washing machine motor providing a dual-power while having a double rotor-double stator structure, and a washing machine using the same, particularly to a full-automatic washing machine, in which a washing tub and a pulsator are driven independently to thereby remove an existing clutch apparatus and simplify the structure of the washing motor.

The invention claimed is:

1. A washing machine motor driving apparatus comprising:

an outer rotor;

an inner rotor;

a double stator disposed with an air gap between the inner rotor and the outer rotor, and driving the inner rotor and the outer rotor independently;

a first cylindrical outer shaft connected to the outer rotor;

a second cylindrical outer shaft connected to a washing tub;

a first inner shaft rotatably disposed inside the first cylindrical shaft and connected to the inner rotor;

a second inner shaft rotatably disposed inside the second cylindrical shaft and connected to a pulsator inside the washing tub; and a planetary gear set comprising: a ring gear fixedly coupled to the first cylindrical outer shaft and the second cylindrical outer shaft; a sun gear fixedly coupled to the first inner shaft; a plurality of planetary gears rotatably engaged with an outer surface of the sun gear and an inner surface of the ring gear; and a carrier coupled to the second inner shaft and rotatably supporting the planetary gears, wherein the planetary gear set is configured in such a way that, when a rotational force from the inner rotor is applied to the sun gear through the first inner shaft, a rotational speed of the inner rotor is decelerated through the planetary gears and is transmitted to the pulsator through the carrier and the second inner shaft; and, when a rotational force from the outer rotor is applied to the ring gear through the first cylindrical outer shaft, a rotational speed of the outer rotor is not decelerated and is transmitted to the washing tub through the ring gear and the second cylindrical outer shaft, thereby being able to rotate the pulsator and the washing tub in the decelerated speed and the non-decelerated speed, respectively, and in opposite directions to each other.

2. The washing machine driving apparatus of claim 1, wherein a first bearing is supported on an outer surface of the first cylindrical outer shaft and a second bearing is supported on an outer surface of the second cylindrical outer shaft, and wherein the first bearing is mounted on a first bearing housing and the second bearing is mounted on a second bearing housing.

3. The washing machine driving apparatus of claim 2, wherein edge portions of the first and second bearing housings overlap each other and are fixed to an outer tub disposed outside the washing tub.

4. The washing machine driving apparatus of claim 2, wherein the planetary gear set is disposed between the first bearing and the second bearing.

5. The washing machine driving apparatus of claim 1, wherein the inner rotor comprises:

a first magnet disposed with a certain gap from an inner surface of the double stator;

a first back yoke disposed on a rear surface of the first magnet; and an inner rotor support to one end of which the first magnet and the first back yoke are fixed, and the other end of which is connected to the first inner shaft, wherein the inner rotor support is integrally formed with the first magnet and the first back yoke by insert molding.

6. The washing machine driving apparatus of claim 1, wherein the outer rotor comprises:

a second magnet disposed with a certain gap from an outer surface of the double stator;

a second back yoke disposed on a rear surface of the second magnet; and an outer rotor support to one end of which the second magnet and the second back yoke are fixed, and the other end of which is connected to the first cylindrical outer shaft, wherein the outer rotor support is integrally formed with the second magnet and the second back yoke by insert molding.

7. The washing machine driving apparatus of claim 1, wherein the double stator comprises: a plurality of stator cores that are made of a split type and assembled and arranged in an annular form; bobbins that are wrapped on respective outer circumferential surfaces of the plurality of stator cores; a first coil wound on one side of each of the stator cores; a second coil wound on the other side of each of the stator cores; and a stator support in which the plurality of stator cores are arranged and integrated in an annular shape and that is fixed to a bearing housing.

8. The washing machine driving apparatus of claim 7, wherein the stator support is integrally formed with the plurality of stator cores by insert molding.

9. A washing machine comprising:

the washing machine driving apparatus according to claim 1:

an outer tub that accommodates wash water;

the washing tub rotatably disposed inside the outer tub to thus perform washing and dehydrating; and the pulsator rotatably disposed inside the washing tub to thus form wash water flows.

10. The washing machine of claim 9, wherein the pulsator and the washing tub of the washing machine are driven in different directions and at different speeds from each other, so as to form strong wash water flows in a pattern form.

11. The washing machine of claim 9, wherein the pulsator and the washing tub of the washing machine are driven at an identical speed to each other, so as to form strong wash water flows to heighten a cleaning capability.

12. The washing machine of claim 10, further comprising first and second bearings that are provided in the first cylindrical outer shaft and the second cylindrical outer shaft, respectively.

* * * * *